US005326169A

United States Patent [19]

Bricker

[11] Patent Number: 5,326,169

[45] Date of Patent: Jul. 5, 1994

[54] PAN RACK FOR MIXING MACHINE

[76] Inventor: Melvin E. Bricker, 2723 Saddleback Dr., Cincinnati, Ohio 45244

[21] Appl. No.: 34,274

[22] Filed: Mar. 22, 1993

[51] Int. Cl.[5] ..... B01F 15/00

[52] U.S. Cl. ..... 366/349; 241/100; 248/302; 366/197

[58] Field of Search ..... 366/64-67, 366/96-99, 197-204, 207, 349; 211/71, 119, 126; 248/249, 250, 302; 241/100

[56] References Cited

U.S. PATENT DOCUMENTS

| | | | |
|---|---|---|---|
| 1,548,041 | 8/1925 | Johnston et al. | 366/197 |
| 1,819,713 | 8/1931 | Klein | 248/302 X |
| 3,063,486 | 11/1962 | Ohms | 248/250 X |
| 3,172,373 | 3/1965 | Waterman | 241/100 X |
| 3,502,294 | 3/1970 | Kalbow et al. | 211/71 X |

FOREIGN PATENT DOCUMENTS

| | | | |
|---|---|---|---|
| 325777 | 2/1930 | United Kingdom | 366/197 |

OTHER PUBLICATIONS

Brochure, "Food Mixer Pan-Trays!", Bricker-Hogo, Inc., 76 E. McMicken Avenue, Cincinnati, Ohio 45210, 1969.

Brochure, Food Mixer Pan Trays, Marc Mfg., Inc., date unknown.

*Primary Examiner*—Timothy F. Simone
*Assistant Examiner*—Charles Cooley
*Attorney, Agent, or Firm*—Wood, Herron & Evans

[57] ABSTRACT

A pan rack for a mixing machine is mounted to the mixing machine independent of dimensional and locational variances from machine to machine of typical bowl support mounting pins and hole. The pan rack has a mounting section which includes a hook that engages the lower surface of the bowl support, and the mounting section further has spaced corners that rest on the upper surface of the bowl support such that the pins on the upper surface of the bowl support are received by the mounting section corners. A locking collar is slidably mounted on the hook. The collar is moved into contact with the front surface and locked on the hook to prevent horizontal motion of the pan rack.

13 Claims, 2 Drawing Sheets

PAN RACK FOR MIXING MACHINE

BACKGROUND OF THE INVENTION

1. Field of the Invention

The present invention relates generally to the area of agitating, and more particularly, to a pan rack support for a mixing machine.

2. Description of the Related Art

Typically mixing machines in the food processing industry have a gear head driving a beater shaft attached to a beater that extends into a mixing bowl supported on the mixing machine. Many mixing machines further have a power take off at the front of the gear head to which processing attachments, such as dicers, slicers, grinders or other processing attachments may be connected. The processing attachment discharges processed food forward of the mixing machine and its bowl support. Therefore, support attachments are available which connect to the mixing machine and support a pan or tray to receive the processed food from the processing attachment.

For example, U.S. Pat. No. 3,063,486, discloses a solid platform for a mixer with a horizontal pin that inserts a hole in the bowl support. The platform also has holes in side extending wings that receive pins on the bowl support thereby mounting the platform to the bowl support for holding a pan beneath a grinding attachment attached to the front end of the mixer.

Other pan racks are commercially available which are comprised of a wire frame construction having a similar horizontal end pin that inserts into a hole in the bowl support. The wire frame pan rack has a cross member with holes for receiving the bowl support pins thereby mounting the pan rack on the bowl support. The pan rack has a first section for supporting the pan and a second section offset vertically above the first section which contains the cross member and horizontal pin. The outer end of the first section is tilted vertically upward approximately 4° with respect to the horizontal which helps hold the pan on the rack. A disadvantage of this pan rack is that cross member may become bent during handling and use which will cause a misalignment of the holes relative to each other and the horizontal end pin.

The above rack designs have the disadvantage of utilizing the pins and hole on the bowl support of the mixers. Utilization of the existing pins and hole requires that the mating holes and pin on the rack be adapted to accommodate the variations in diameter of the bowl support pins and hole and relative locations thereof. Reducing the diameter of the mating components on the rack to accommodate all possible variations of bowl support pin and hole size may result in a rack that can be mounted on every machine but does not fit properly on any machine. That is, the rack fits so loosely that it vibrates, is noisy and does not appear to be a quality product. There are further disadvantages in that the construction of prior racks and the machining requirements for manufacturing increase their cost.

SUMMARY OF THE INVENTION

To overcome the disadvantages of existing pan racks for mixing machines, the present invention provides a pan rack for a mixing machine that is insensitive to dimensional and location variations of the pins and hole of the bowl support from one mixing machine to another.

According to the principles of the present invention and in accordance with the described embodiments, a pan rack is provided for use with a mixing machine having a bowl support including a lower surface and two opposed outwardly directed arms. Each of the arms has a pin mounted at the end on an upper surface. The pan rack has a hook for engaging the lower surface of the bowl support and first and second corners which are mounted on the upper surface of the arms for receiving the pins within the corners. The hook and first and second corners cooperate with the bowl support such that pan rack is supported in the vertical direction restrained from motion in the horizontal direction.

The pan rack has a mounting section with the hook and first and second corners at an inner end and a generally horizontal support section for holding the pan. The rack also has a generally vertical connecting section connected between an outer end of the mounting section and an inner end of the support section.

The hook is comprised of an elbow having a horizontal arm in contact with the lower surface of the bowl support and a vertical arm extending upward adjacent the front surface of the bowl support. A locking collar has an internal bore for receiving the horizontal arm and a screw radially threaded through the collar for locking the collar on the horizontal arm. In mounting the rack to the bowl support, the spaced corners are slid into contact with bowl support pins. The collar is then moved into contact with the front surface of the bowl support and locked in that position.

The pan rack of the present invention has the advantage of not requiring holes on the pan rack to engage the pins on the bowl support, nor does the rack require a pin to engage a hole in the bowl support. Therefore, a pan rack may be manufactured that engages with bowl supports of mixing machines regardless of the dimensional and locational variations of the pins and hole on the bowl supports. The locking collar on the pan rack provides a more stable mounting. A longer connecting section permits the use of deeper pans thereby reducing food handling and food spillage. The two piece rack construction requires no machining and only two welds and is simpler and less expensive to fabricate.

DETAILED DESCRIPTION OF THE INVENTION

Figure 1:
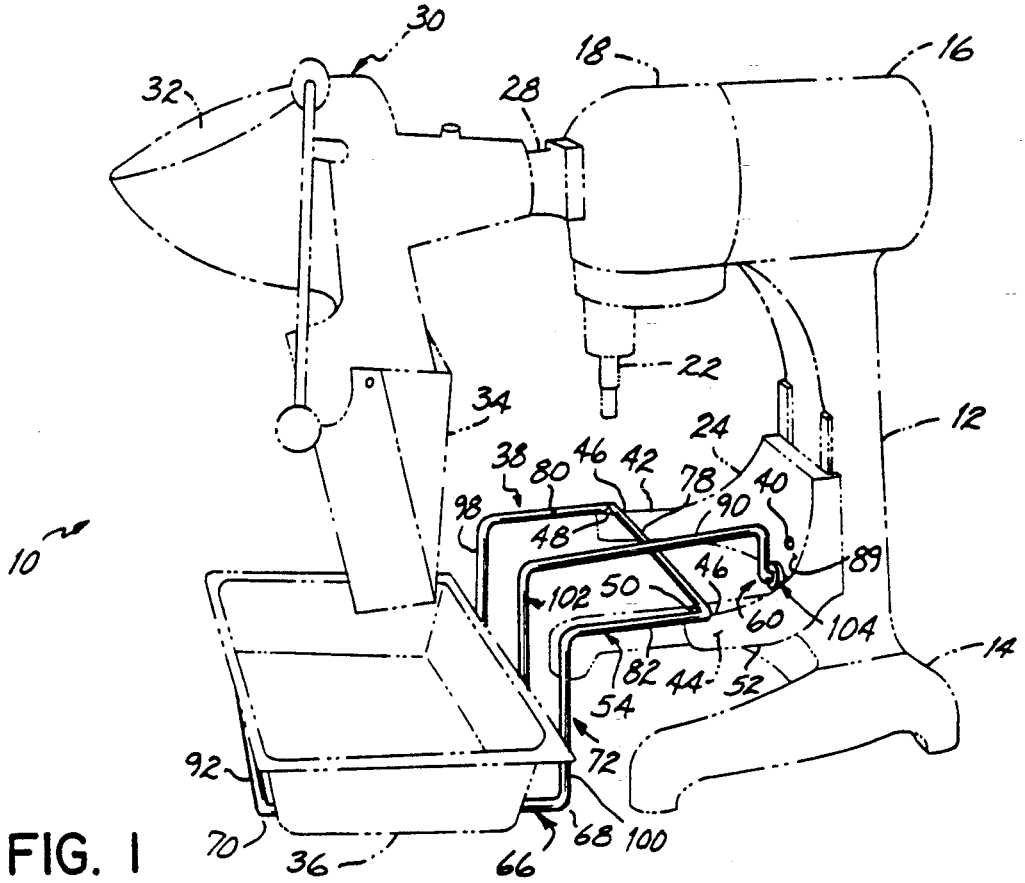
FIG. 1 is a perspective side view of the pan rack supporting a pan shown in phantom and mounted to a vertical mixing machine, shown in phantom.

FIG. 1 illustrates a mixing machine 10 such as the food mixers that are typically used in the food processing industry. The mixing machine 10 has a column 12 extending into a base 14 which contacts a surface on which the mixing machine 10 is supported. A motor 16 is mounted on the upper end of the column 12 and provides an output shaft (not shown) into a gear head 18. The gear head provides mechanical power to a beater shaft 22 to which a beater (not shown) may be attracted. A bowl support 24 is slidably mounted on the column 12 so that bowls of different sizes may be adjusted vertically with respect to the beater shaft 22.

In other applications, it may be desired to use the mixing machine 10 for dicing, slicing, grinding or otherwise processing food products. In that case, a processing attachment 30 is connected to a power take-off drive 28 extending from the head gear 18. The attachment 30 receives material to be processed through an inlet chute 32 and discharges processed material from an output chute 34 into a pan 36. The pan is supported by the pan rack 38 of the present invention.

The bowl support 24 includes a hole 40 which is engaged by pins of the prior art pan racks. The bowl support has first and second arms 42 and 44, respectively, that extend outward and forward from the column 12. The arms have a horizontal upper surface 46, and first and second pins 48 and 50 are located on the upper surface 46 at the ends of the arms. The bowl support further has a horizontal lower surface 52.

Figure 2:
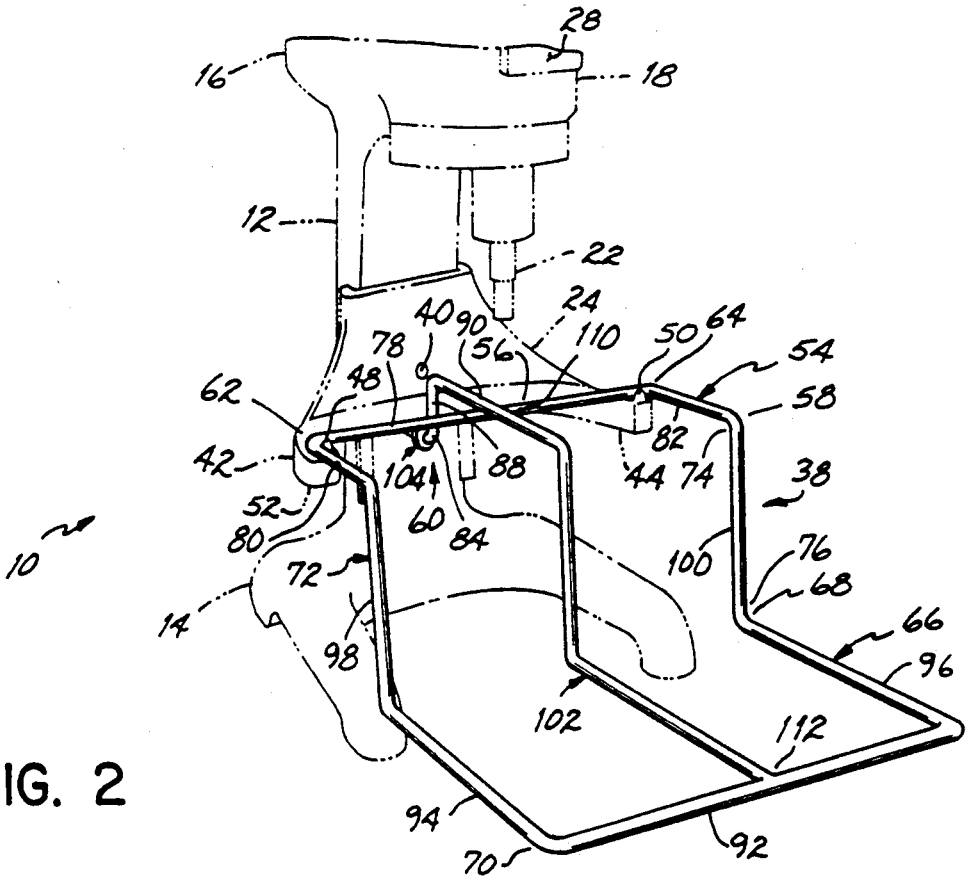
FIG. 2 is a frontal perspective view illustrating the pan rack mounted on a vertical mixing machine also shown in phantom.

Referring to FIG. 2, the pan rack 38 has a mounting section 54 with an inner end 56 adjacent the mixing 10 and an outer end surface 58. The mounting section also has a hook 60 extending from the inner end 56 toward the mixing machine for engaging the lower surface 52 of the bowl support 24. The mounting section 54 further has first and second corners 62 and 64 which are spaced apart to receive the first and second pins 48 and 50, respectively. The hook 60 and the first and second corners 62 and 64 engage the bowl support 24 such that the pan rack 38 is supported in the vertical direction and restrained from motion in the horizontal direction.

The pan rack 38 further includes a support section 66 for holding the pan, and the support section 66 has an inner end 68 and an outer end 70. A vertical connecting section 72 has an upper end 74 connected to the outer end 58 of the mounting section 54. The connecting section 72 further has a lower end 76 connected to the inner end 68 of the support section 66. The connecting section 72 offsets the location of the support section 66 in a vertically downward direction from the mounting section 54.

Figure 3:
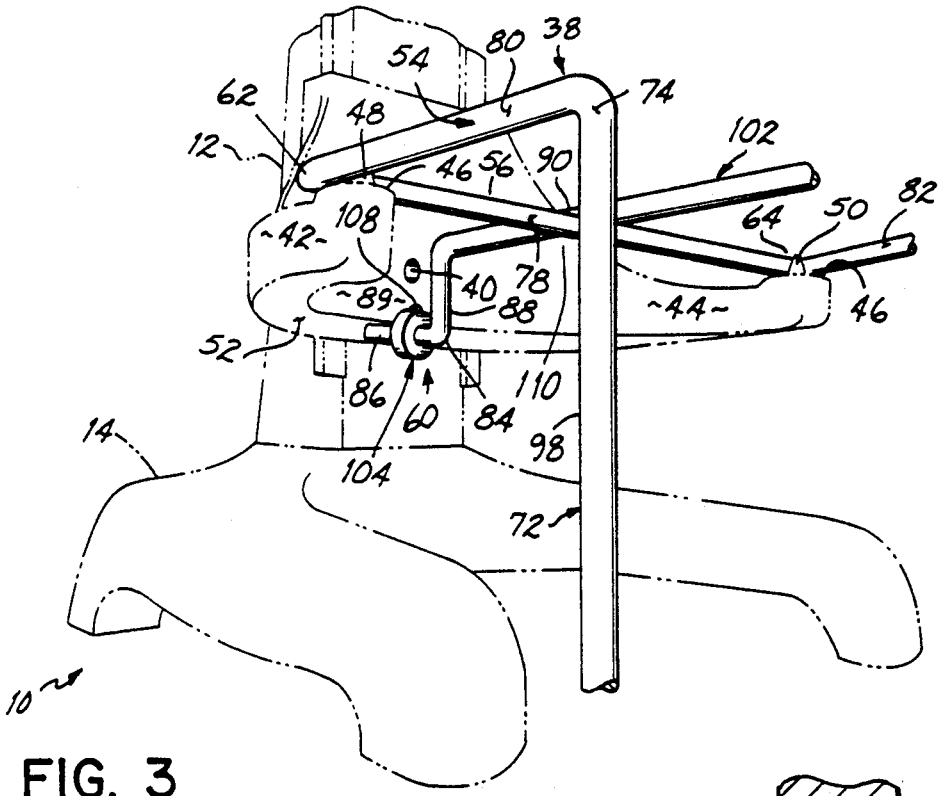
FIG. 3 is a lower frontal perspective view illustrating the locking collar on the hook of the pan rack.

The mounting section 54 includes a first side member 80 which has an inner end connected to one end of the inner end member 78 at a right angle, thereby creating the first corner 62. A second side member 82 has an inner end connected to the opposite end of the inner end member 78 at a right angle thereby forming the second corner 64. Referring to FIG. 3, the hook 60 has an elbow 84 formed at the intersection of a horizontal arm 86 and a vertical arm 88. The horizontal arm 86 is in contact with the lower surface 52 of the bowl support 24, and the vertical arm 88 extends vertically upward adjacent a front surface 89 of the bowl support 24. The hook 60 is connected to an offset arm 90 which extends horizontally from the upper end of the vertical arm 88 to the inner end member 78. The offset arm 90 offsets the elbow from the inner end member 78 inwardly toward the bowl support 24 of the mixing machine.

As shown in FIG. 2, the support section 66 has an outer end member 92 having one end connected to and forming a right angle with one end of a third side member 94. A fourth side member 96 is connected to the other end of the outer end member 92 and forms a right angle therewith. The connecting section 72 has a vertical fifth side member 98 which has its upper end connected to the outer end of the first side member 80, and the lower end of the side member 98 is connected to the inner end of the third side member 94. The connecting section 72 has a vertical sixth side member 100 which has its upper end connected to the outer end of the second side member 82, and the lower end of the sixth side member 100 is connected to the inner end of the fourth side member 96.

The pan rack further includes an intermediate member 102 having an outer end connected to the outer end member 92. The intermediate member 102 extends inwardly from the outer end member 92 across the support section 66 and parallel to the third and fourth members 94 and 96, respectively. The intermediate member 102 also extends in a vertically upward direction across the connecting section 72 and parallel to the fifth and sixth side members 98 and 100, respectively. The intermediate member further extends horizontally across the mounting section 54 parallel to the first and second side members 80,82. The intermediate member 102 terminates at an opposite end which is connected to the inner end member 78. The intermediate member 102 is centrally located within the mounting section 54, the connecting section 72 and the support section 66; and the intermediate member 102 is connected to the inner and outer end members 78 and 92, respectively, at a point approximately equidistant between their ends.

The support section 66 is connected to the connecting section 72 such that the support section 66 is inclined approximately 10° with respect to the horizontal. Therefore, the outer end member 92 at the outer end 70 of support section 66 is raised approximately 10° with respect to the inner end 68 of the support section 66. The 10° tilt of the support section 66 is substantially greater than the 4° tilt typically found in the prior art pan racks. The additional tilt permits the use of larger pans to accommodate greater quantities of processed food. As the weight supported by the support section 66 increases, support section 66 will deflect in a vertically downward direction toward the horizontal. As long as the outer end member 92 remains above the horizontal, any motion of the pan 36 caused by machine vibration or otherwise will be directed primarily toward the connecting section 72 thereby holding the pan on the pan rack.

Figure 4:
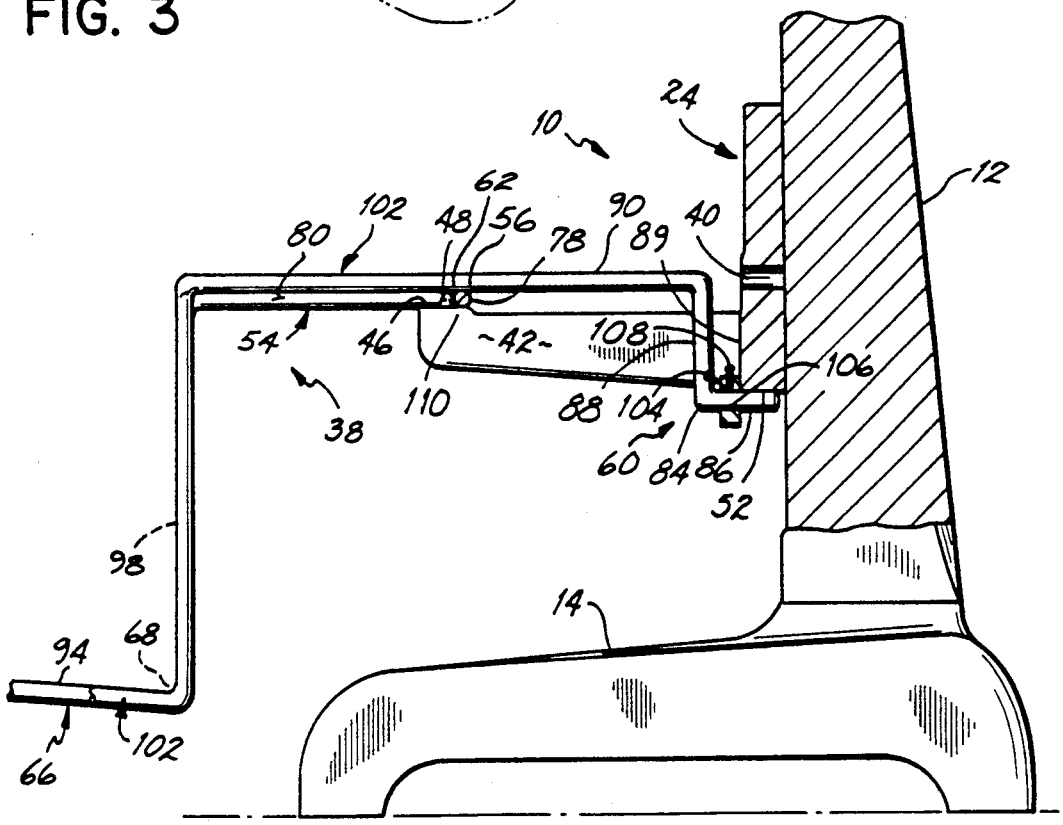
FIG. 4 is a cross-sectional side view of the pan rack illustrating the locking collar.

Referring to FIGS. 3 and 4, to more securely mounted the pan rack 38 on the mixing machine 10, a locking collar 104 has an internal bore 106 for receiving the horizontal arm 86. A screw 108 is in.threaded engagement with the locking collar 104 such that the screw moves in a radial direction into and out of the internal bore 106.

In mounting the pan rack on the mixing machine, the horizontal arm 86 is moved under and into contact with the lower surface 52 of the bowl support 24. The corners 62, 64 of the pan rack 38 are lowered onto the upper surface 46 of the bowl support 24 such that the pins 48 and 50 are located within the first second corners 62 and 64, respectively. The hook 60 and corners 62, 64 hold the pan rack 38 in an approximately horizontal position. The pan rack 38 is slid outwardly away from the bowl support 24 until the pins 62, 64 contact the inner end member 78. Holding the pan rack 38 in that position, the screw 108 is loosened to permit the locking collar 104 to slide on the horizontal arm 86. The locking collar is slid into engagement with the front surface 89 of the bowl support 24. The screw 108 is tightened to engage the horizontal arm 86 thereby securing the locking collar in that position. Therefore, the locking collar 104 and the corners 62, 64 prevent horizontal motion of the pan rack 38 thereby providing a stable and secure mounting to the mixing machine 10.

The pan rack 38 may be mounted on the mixing machine 10 independent of dimensional and locational variations of the pins 48 and 50 with respect to the hole 40. The pan rack 38 requires no machining and therefore is substantially less expensive to manufacture than previous racks. The inner and outer end members 78 and 92 and the first, second third, fourth, fifth and sixth side members 80, 82, 94, 96, 98 and 100, respectively, are formed from a first piece of rod material. Further, the intermediate arm 102, offset arm 90, vertical arm 88 and horizontal arm 86 are formed from a second piece of rod material. Preferably, at a first weld joint 110 (FIG. 2), the ends of the first piece of rod material are welded together with the offset arm 90 of the second piece of rod material. A second weld joint 112 connects the intermediate member 102 to the outer end member 92, thereby completing the pan rack assembly.

While the present invention has been set forth in considerable detail, it is not intended to restrict or in any way limit the claims to such detail. Additional advantages and modifications will readily appear to those who are skilled in the art. For example, instead of attaching the intermediate member 102 to the top side of the inner end member 78, it may be positioned on the bottom side of the inner end member 78 with the appropriate adjustment of the length of the vertical arm 88. Additional intermediate members may be utilized, and the intermediate member 102 does not have to be contiguous with the offset arm 90. The pan rack 38 may be constructed of other materials such as stainless steel. The length of the connecting section may vary depending on the type of mixing machine and side pins the pan rack is to accommodate. The invention in its broadest aspects is therefore not limited to the specific details represented and illustrated examples described. Accordingly, departures may be made from such details without departing from the spirit and scope of the general inventive concept.

What is claimed is:

1. An attachment of the type supporting a pan for use with a mixing machine having a column with a bowl support, said bowl support having a lower surface and two opposed arms directed generally outward and forward from the column and including a pair of pins, each pin being mounted on an upper surface of one of the arms, the attachment comprising:

a mounting section having an inner end and an opposing outer end, said inner end of said mounting section having an inner end member adapted to be located adjacent the column, a first side member having an inner end connected to one end of said inner end member to form a first corner adapted to engage one of the pair of pins, and a second side member having an inner end connected to an opposite end of said inner end member to form a second corner adapted to engage another of the pair of pins, an elbow-shaped hook including a first arm including an upper end connected to said inner end member and a lower end extending downward from the upper end, and a second arm having one end connected to the lower end of said first arm and having an opposite end extending generally horizontally and adapted to contact the lower surface of the bowl support; and means connected to the mounting section for supporting the pan.

2. The attachment of claim 1 wherein the attachment further comprises a locking device engagable with said second arm of said elbow-shaped hook, said locking device being locked on said second arm in response to said inner end member being moved into contact with the pins and said locking device being moved into contact with a front surface of the bowl support.

3. The attachment of claim 2 wherein said locking device further comprises:

a collar having an internal bore for receiving the second arm; and a screw in threaded engagement with the collar for moving radially into and out of said internal bore, whereby said screw is selectively moved into engagement with said second arm thereby locking said collar on said second arm.

4. The attachment of claim 1 wherein the means for supporting comprises:

a support section adapted to support the pan and having an inner end and an outer end; and a connecting section having an upper end connected to said outer end of said mounting section and a lower end connected to said inner end of said support section, said connecting section offsetting said support section vertically downward from said mounting section.

5. The attachment of claim 4 wherein said support section further comprises:

an outer end member;

a third side member connected to and forming a right angle with one end of said outer end member; and a fourth side member connected to and forming a right angle with an opposite end of said outer end member.

6. The attachment of claim 5 wherein said connecting section further comprises:

a fifth side member connected between said first and third side members, thereby forming a contiguous side member between said one ends of said inner and outer end members; and a sixth side member connected between said second and fourth side members, thereby forming a contiguous side member between said opposite ends of said inner and outer end members.

7. The attachment of claim 6 wherein said attachment further comprises an intermediate member having an outer end connected to said outer end member, and adapted to extend across said support section, said connecting section and said mounting section and having an opposite end connected to said inner end member.

8. The attachment of claim 7 wherein said ends of said intermediate member are connected approximately equidistant between said ends of said inner and outer end members.

9. The attachment of claim 8 wherein said support section is tilted upward at its outer end approximately 10° relative to the horizontal.

10. The attachment of claim 7 wherein said inner and outer end members and said first, second, third, fourth, fifth and sixth side members are made from a first piece of rod material.

11. The attachment of claim 10 wherein said first arm of said elbow-shaped shaped hook further comprises an offset arm connected between the upper end of said first arm and said inner end member.

12. The attachment of claim 11 wherein said first arm, said second arm, said offset arm and said intermediate member are made from a second piece of rod material.

13. An attachment of the type supporting a pan for use with a mixing machine having a column with a bowl support, said bowl support having a lower surface and two opposed arms directed outward from the column and including a pair of pins, each pin being mounted on an upper surface of one of the arms, the attachment comprising:

a mounting section having an inner end and an outer end, said inner end of said mounting section having an inner end member adapted to be located adjacent the column, a first side member connected to one end of said inner end member wherein said first side member and the one end of said inner end member form a first corner adapted to engage one of the pair of pins, and a second side member connected to an opposite end of said inner end member, wherein said second side member and said opposite end of said inner end member form a second corner adapted to engage another of the pair of pins;

an elbow-shaped hook connected to said inner end member, said elbow-shaped hook including a substantially horizontal arm adapted to contact the lower surface of the bowl support; and a substantially vertical arm connected to the substantially horizontal arm and adapted to extend upward adjacent a front surface of the bowl support;

a support section adapted to support the pan and having an inner end and an outer end; and a connecting section having an upper end connected to said outer end of said mounting section and a lower end connected to said inner end of said support section, said connecting section offsetting said support section vertically downward from said mounting section.

* * * * *